US006733312B2

(12) United States Patent
Fujii

(10) Patent No.: US 6,733,312 B2
(45) Date of Patent: May 11, 2004

(54) CONNECTOR

(75) Inventor: Masayasu Fujii, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/199,251

(22) Filed: Jul. 18, 2002

(65) Prior Publication Data

US 2003/0017733 A1 Jan. 23, 2003

(30) Foreign Application Priority Data

Jul. 19, 2001 (JP) ..... 2001-220346
Jul. 19, 2001 (JP) ..... 2001-220347
Jul. 19, 2001 (JP) ..... 2001-220348

(51) Int. Cl.[7] ..... H01R 13/62
(52) U.S. Cl. ..... 439/157
(58) Field of Search ..... 439/157, 160, 439/352, 372

(56) References Cited

U.S. PATENT DOCUMENTS 5,709,560 A 1/1998 Hio ..... 439/157
6,413,105 B2 * 7/2002 Noro et al. ..... 439/157

* cited by examiner

*Primary Examiner*—Renee Luebke
*Assistant Examiner*—Ann McCamey
(74) *Attorney, Agent, or Firm*—Anthony J. Casella; Gerald E. Hespos

(57) ABSTRACT

A connector (20) has a housing (21) and a lever (35) on outer surfaces of the housing (21). The housing (21) has two first resilient pieces (43) and two second resilient pieces (44) engageable with the lever (35). The lever (35) is held at an initial position by engaging first holding projections (47) of the first resilient pieces (43) in first engaging holes (48) in arms (36) of the lever (35) and by engaging second holding projections (49) of the, second resilient pieces (44) with engaging pieces (50) on the arms (36). The lever (35) can be rotated toward a shelter position so that the second resilient pieces (44) deform inwardly. The second resilient pieces (44) are restored resiliently to engage the second holding projections (49) with the second engaging holes (51) in the arms (36) to hold the lever (35) at the shelter position.

12 Claims, 16 Drawing Sheets

CONNECTOR

BACKGROUND OF THE INVENTION

1. Field of the Invention

The present invention relates to a lever-type connector.

2. Description of the Related Art

A known lever-type connector is disclosed in U.S. Pat. No. 5,709,560 and includes male and female housings that are connectable with one another. A lever is mounted rotatably on the male housing and is formed with a cam groove. The female housing has a cam pin that is displaced along the cam groove as the lever is rotated for pulling the male and female housings together.

The male and female housings and the lever are molded at a molding site and are transported to an assembling site. The housings are connected at the assembly site with the lever mounted at the initial position on the male housing. However, the lever at the initial position projects from the male housing. Thus, there is a possibility that the lever will deform or break due to interference of another part with the projecting portion.

Consideration has been given to mounting the lever at a shelter position where a projecting amount of the lever from the male housing is small. Deformation of the lever and other undesired events are avoided if the lever is placed at the shelter position on the male housing before transportation. The lever is returned to the initial position after transportation to the assembling site so that the male and female housings can be connected.

Two holding means need to be provided between the lever and the housing to hold the lever respectively at the shelter position and the initial position. This leads to a more complicated construction of the connector.

The known lever has a resilient piece that engages an engaging portion on the male housing to hold the lever at the initial position. The resilient piece is deformed by a disengaging portion on the female housing and disengages from the engaging portion as the housings are connected.

The resilient piece is formed by a cut in the plate-shaped lever. However, it is difficult to prevent excessive deformation of the resilient piece, and the resilient piece may be damaged by another part during transportation.

Excessive deformation of the resilient piece could be prevented by: providing the resilient piece on the housing instead of on the lever; making the resilient piece deformable inwardly; and providing a receiving portion at a back side of the resilient piece. If the resilient piece is deformable inwardly, it is necessary to: make the housing with the resilient piece fit into a mating housing; provide a disengaging portion on an inner wall of the mating housing; and press the resilient piece in with the disengaging portion to disengage the resilient piece from the lever during connection of the housings.

The lever may open slightly outward due to a restoring force of the resilient piece when the lever rotates beyond the resilient piece that has been deformed by the disengaging portion. The open portion of the outwardly open lever interferes with the inner surface of the mating housing to hinder the rotation of the lever. As a result, the lever may not rotate smoothly.

The invention was developed in view of the above problem and an object is to provide a simple connector with improved overall operability.

SUMMARY OF THE INVENTION

The invention relates to a connector with a housing that is connectable with a mating housing. A movable member is mounted on the housing for movement between initial and end positions. The movable member has a cam groove that can engage a cam pin on the mating housing. The housings can be connected or separated by displacing the cam pin along the cam groove as the movable member is moved between the initial and end positions. An initial position holding means is provided for holding the movable member at the initial position, and a shelter position holding means is provided for holding the movable member at a shelter position. A projecting amount of the movable member from the outer surface of the housing at the shelter position is less than at the initial position. Additionally, the initial position holding means and the shelter position holding means are part of a common element. Accordingly, the construction of the connector is simplified.

The connector may be a lever-type connector, and the movable member may be a lever rotatably mounted on the housing. Thus, the housings are connected or separated by displacing the cam pin along the cam groove as the lever is rotated from the initial position toward the end position.

The lever may be mounted on the housing at the shelter position before the housing and the lever are transported to an assembling site. Accordingly, the lever is not likely to be damaged by interference with other parts during transportation. The lever may be moved from the shelter position to the initial position after the connector has been transported to the assembling site. The housings subsequently are connected to each other.

The common element for the initial position holding means and the shelter position holding means may comprise a deformable resilient piece integrally or unitarily formed with the housing. The lever is held at the initial position and the shelter position by engaging the resilient piece with an initial position engaging portion and a shelter position engaging portion, respectively.

Resilient pieces may be on opposite sides of the housing and may be resiliently deformable inwardly. Thus, the resilient pieces can be pressed from outer sides by fingers and can be deformed inwardly for disengagement from the initial position engaging portion. The lever then can be rotated easily from the initial position to the shelter position for transportation.

The initial position engaging portion may be near an outer end of a trace of movement of the movable member. Thus, a sufficient holding force for the movable member can be ensured and the movable member can be held securely at the initial position.

At least one of the resilient piece and the shelter position engaging portion has a slanted disengagement guiding surface to disengage the resilient piece from the shelter position engaging portion when a force of at least a specified magnitude acts on the movable member to move the movable member toward the initial position. Thus, the movable member is semi-locked at the shelter position, and can be returned easily from the shelter position to the initial position after transportation to the assembling site.

The resilient piece may comprise a reinforcing projection that projects opposite from a deforming direction of the resilient piece and that has a slanted surface with an inclination substantially continuous with the disengagement guiding surface. As a result, the holding force for the movable member is reinforced without degrading the movement operability of the movable member.

The shelter position and the end position of the movable member preferably are identical, and the movable member can be held at the shelter position and the end position by the shelter position holding means.

A detection sound creating means preferably is provided for creating a detection sound as the movable member strikes the housing. Thus, the movable member is not likely to be left at an intermediate position.

The housing may comprise at least one excessive deformation preventing means for preventing excessive deformation of the resilient piece. Accordingly, the resilient piece is not likely to be damaged even if other parts strike against the resilient piece during transportation.

The resilient piece preferably is formed by cutting an outer wall of the housing, and/or the excessive deformation preventing means is formed by a cut edge of the outer wall at a back side with respect to a deforming direction of the resilient piece. Thus, excessive deformation of the resilient piece can be prevented by the engagement of the deformed resilient piece with the cut edge of the outer wall.

The mating housing may comprises at least one disengaging portion for resiliently deforming the resilient piece and disengaging the resilient piece from the movable member by engaging the resilient piece as the housings are connected. Accordingly, the operability of the movable member is improved.

An escaping portion may be formed in a surface of the mating housing that faces the movable member for permitting the movable member to be opened outwardly as the movable member moves beyond the resilient piece.

When the housings are to be connected, the resilient piece is deformed resiliently inward and is disengaged from the lever by the disengaging portion. Thus, rotation of the lever from the initial position is permitted. When the lever is rotated beyond the resilient piece, the lever is subjected to a restoring force of the resilient piece and opens outwardly. However, the escaping portion in the surface of the housing facing the lever permits the opened lever to escape. Thus, the rotational operability of the lever is satisfactory.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
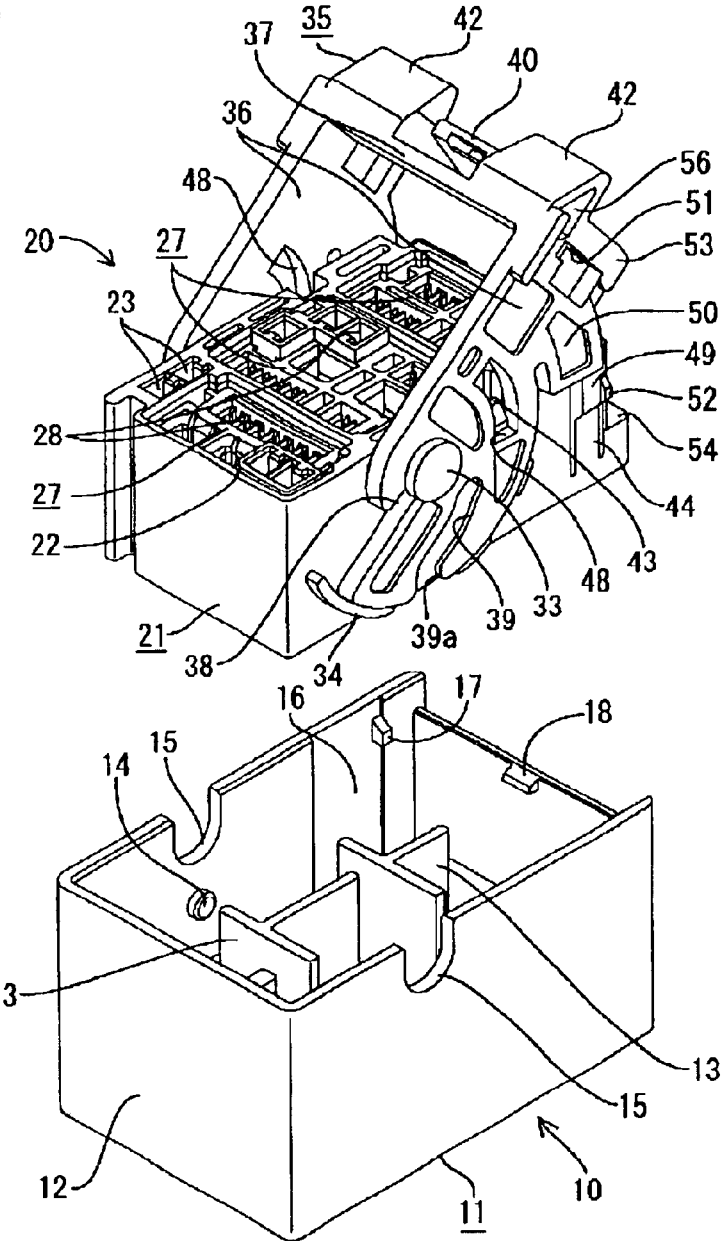
FIG. 1 is an exploded perspective view of a lever-type connector according to one embodiment of the invention.

A lever-type connector according to the invention has a male connector 10 and a female connector 20, as shown in FIGS. 1 to 19. The male housing 10 is formed integrally or unitarily with a junction box (not shown). The female connector 20 has a main housing 21 that accommodates divided housings 27, and a lever 35 is mounted on the main housing 21. The male and female connectors 10 and 20 are connectable with each other, and the sides of the connectors 10, 20 that are to be connected with each other are referred to as the front.

The male connector 10, as shown in FIG. 1, has a male housing 11 made e.g. of a synthetic resin. The male housing 11 is formed unitarily or integrally on the upper surface of the junction box and has a receptacle 12 that opens up toward a mating side. The receptacle 12 is dimensioned to receive the female connector 20. Unillustrated male tab terminals project from the bottom surface of the male housing 11, and two guide pieces 13 of substantially T-shaped cross section project up along a mating direction for guiding the female connector 20 into the receptacle 12.

The receptacle 12 is a wide rectangular tube, with two long side walls and left and right end walls, as shown in FIG. 1. Two round cam pins 14 project toward one another from inner surfaces of the longer walls near the left end wall and notches 15 are formed in front of the cam pins 14 by cutting the open front edges of the receptacle 12. Opposed escaping recesses 16 are formed on the inner surfaces of the longer walls of the receptacle 12 near the right end in FIG. 1, and disengagement projections 17 are formed at right ends of the escaping recesses 16 near the front of the receptacle 12. The front side of each disengagement projection 17 is slanted. The right wall of the receptacle 12 is shorter along the mating direction than the other walls, and a lock projection 18 is provided at the front end of the inner surface of the right wall.

Figure 2:
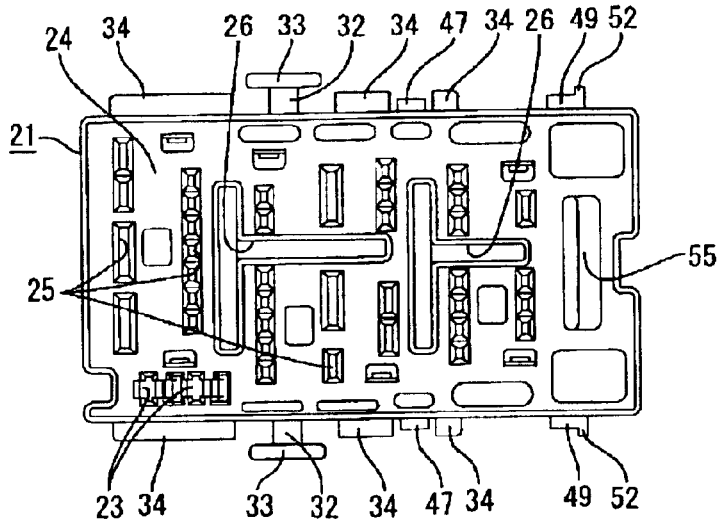
FIG. 2 is a front view of a main housing.
Figure 3:
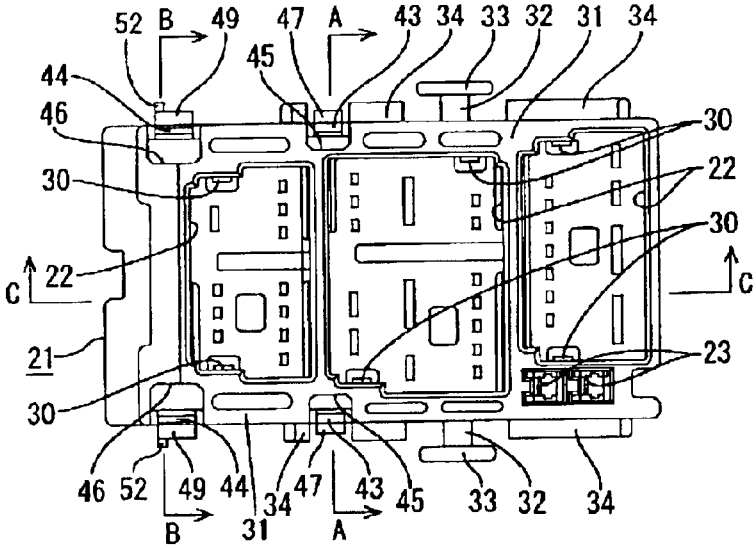
FIG. 3 is a rear view of the main housing.

The main housing 21 of the female connector 20 is made e.g. of a synthetic resin, and defines a wide box that is open to the rear. The inside of the main housing 21 is partitioned vertically to define three side-by-side accommodation chambers 22 for accommodating three divided housings 27 from behind, as shown in FIGS. 1 and 3. Two side-by-side cavities 23 are formed adjacent the right chamber 22 of the main housing 21, as shown in FIG. 3, and female terminal fittings (not shown) connected with ends of wires are insertable from behind into the cavities 23. As shown in FIG. 2, a front wall 24 of the main housing 21 has terminal insertion holes 25 at positions that permit insertion of mating male tab terminals during the connection of the two connectors 10, 20. The front wall 24 also has guide piece insertion holes 26 for permitting insertion of the guide pieces 13.

Figure 12:
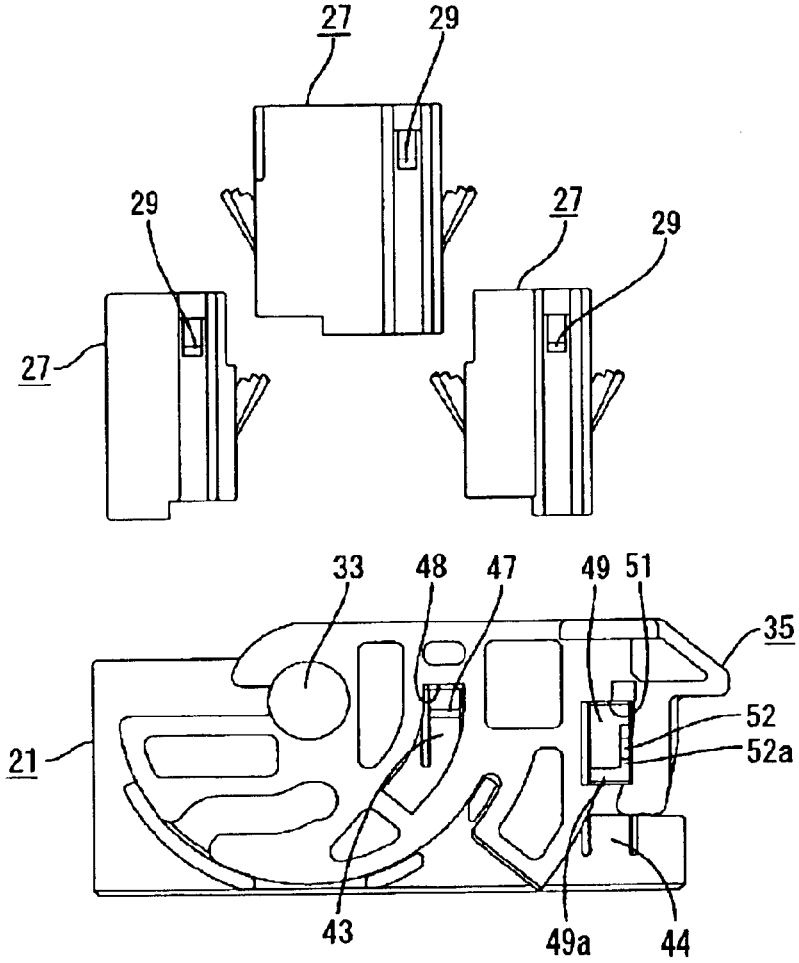
FIG. 12 is a plan view showing a state before divided housings are accommodated into the main housing.

Each divided housing 27 is made e.g. of a synthetic resin and has cavities 28 of different sizes, as shown in FIG. 1, for accommodating different types of female terminal fittings (not shown). The female terminal fittings can be held in the respective cavities 23, 28 by terminal holding means. As shown in FIG. 12, a locking projection 29 is provided on each of the opposite outer side surfaces of each divided housing 27. The locking projections 29 engage the front sides of engaging projections 30 (see FIG. 3) that project from the inner surface of each accommodation chamber 22. Thus, each divided housing 27 is held in the main housing 21. Forwardly open guide grooves (not shown) are formed in the middle and right divided housings 27 for receiving the guide pieces 13 of the male connector 10.

Figure 7A:
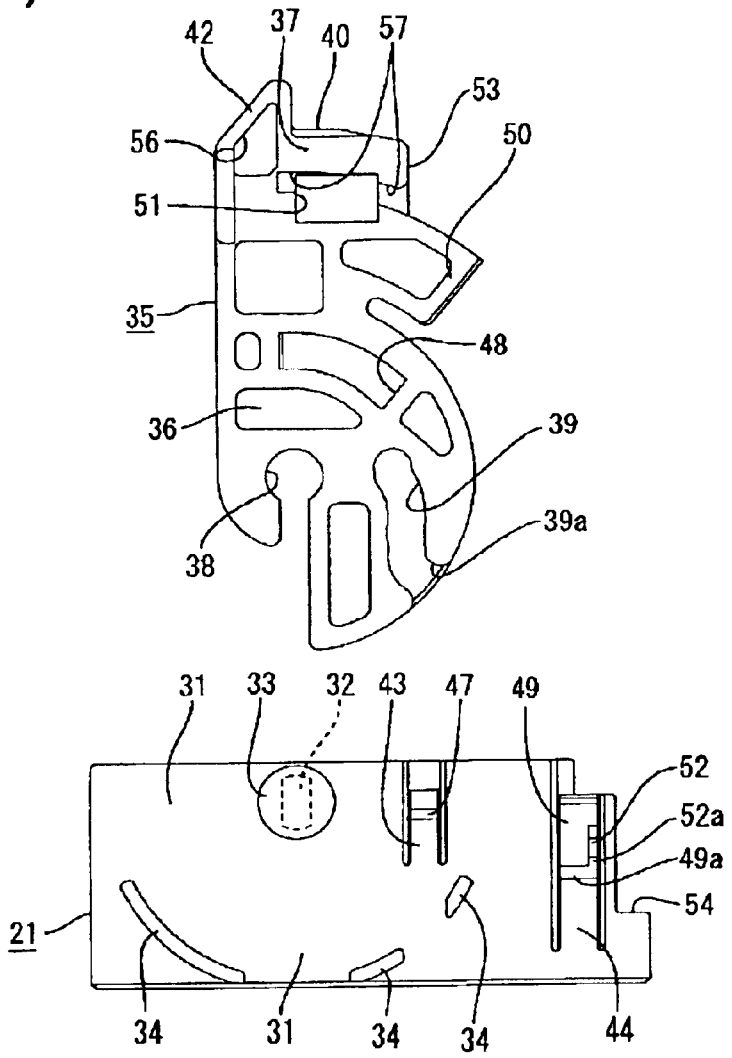
FIG. 7(A) is a plan view showing a state before a lever is mounted on the main housing.
Figure 7B:
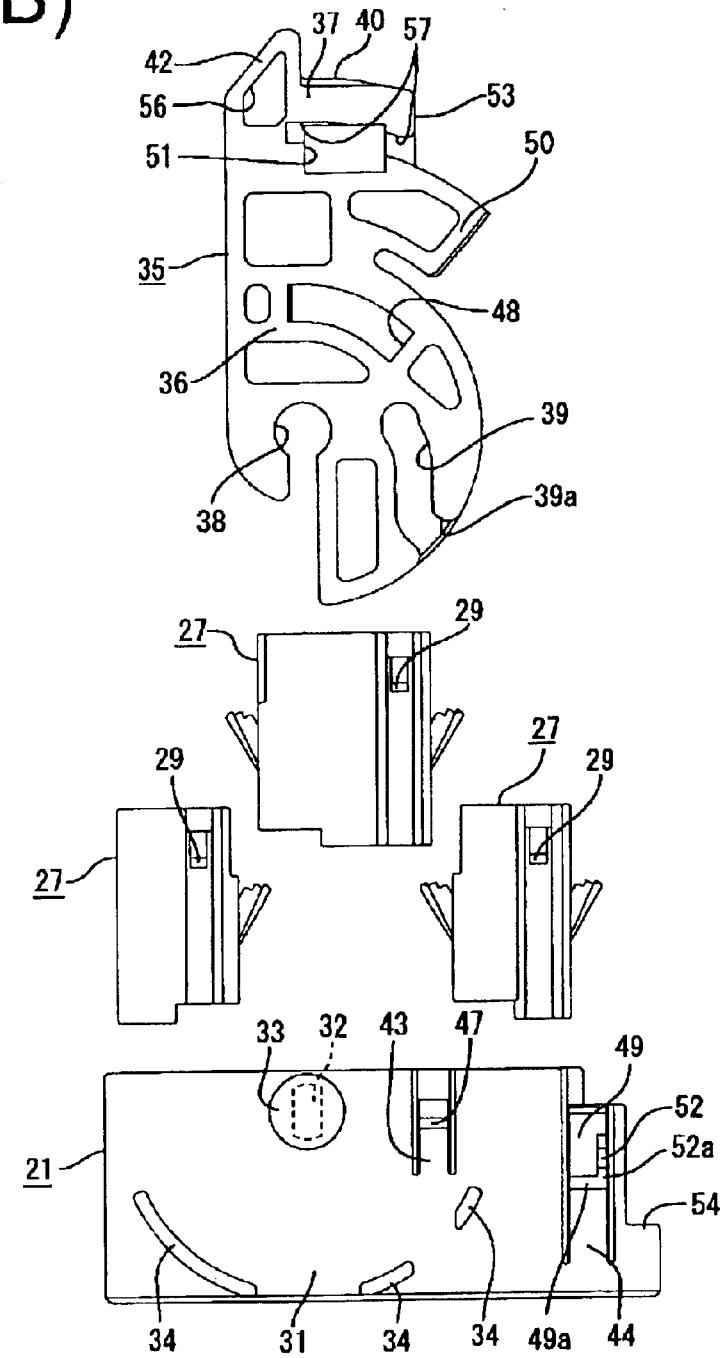
FIG. 7(B) is a plan view showing the main housing, divided housings, and a lever.

Lever supports 32 are provided at back-left positions of the outer surfaces of longer walls 31 of the main housing 21, as shown in FIG. 7, for rotatably supporting the lever 35. Each lever support 32 is a block that is narrow and long in forward and backward directions, and the front and rear surfaces thereof are rounded. A disk-shaped flange 33 is at the projecting end of each lever support 32 for preventing the mounted lever 35 from moving toward the outer side. Rotation guiding ribs 34 are formed on the outer surface of each longer wall 31. The ribs 34 are curved along a path of rotation of the lever 35 and are spaced apart in the azimuthal direction, such that one rib 34 is at the left side and two are at the right side with respect to the lever support 32. The rotation of the lever 35 can be guided by holding the outer periphery of the lever 35 in sliding contact with the respective ribs 34.

As shown in FIG. 1, the lever 35 is made e.g. of a synthetic resin and has two arms 36 with ends that are joined by a coupling 37 to define a bridge or gate shape. The lever 35 is mounted such that the opposite longer walls 31 of the main housing 21 are held between the arms 36. The free ends of the arms 36 have bearing recesses 38 that are supported rotatably on the lever supports 32 from behind (see FIG. 8). As shown in FIG. 7, each bearing recess 38 has an entrance with a width that substantially equals the shorter dimension of each lever support 32. The back of each bearing recess 38 is substantially circularly generated and has a diameter substantially equal to the longer dimension of each lever support 32.

Figure 13:
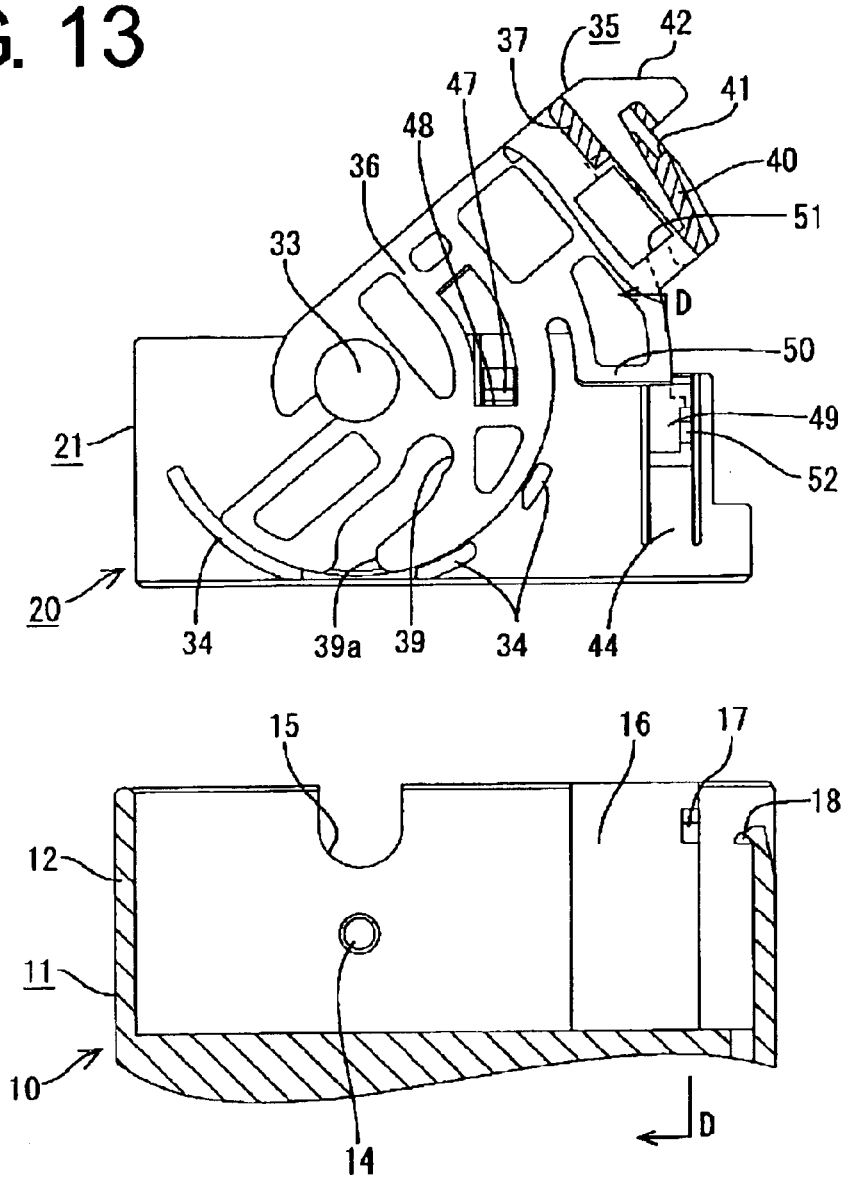
FIG. 13 is a plan view partly in section showing a state before two connectors are connected.

Each arm 36 has a cam groove 39 that is engageable with the corresponding cam pin 14 of the male connector 10. The cam groove 39 has a substantially spiral shape that gradually approaches the bearing recess 38 as it extends back from an entrance 39*a*. Specified areas of the outer periphery of the arm 36 at the left and right sides of the entrance 39*a* of the cam groove 39 define an arc having the bearing recess 38 as a center, and can be brought into sliding contact with the rotation guiding ribs 34. The cam pins 14 can engage in the cam grooves 39 when the lever 35 is mounted on the main housing 21 at an initial position with the entrances 39*a* of the cam grooves 39 facing the front, as shown in FIG. 13. The lever 35 then can be rotated clockwise so that the cam pins 14 displace along the cam grooves 39 to assist in the connection of the two connectors 10, 20. The connectors 10, 20 are connected substantially completely when the lever 35 reaches an end position where the lever supports 32 are in the middle of back ends of the cam grooves 39, as shown in FIG. 18.

A resiliently deformable lock arm 40 is cantilevered from the middle of the coupling 37 of the lever 35 and is engageable with the lock projection 18 of the male connector 10 to hold the connectors 10, 20 together when the lever 35 reaches the end position. A locking step 41 is formed at the free end of the lock arm 40 and is engageable with the rear surface of the lock projection 18. Further, operable portions 42 are at opposite sides of the lock arm 40 at the rear end of the coupling 37, and are used to rotate the lever 35.

Figure 18:
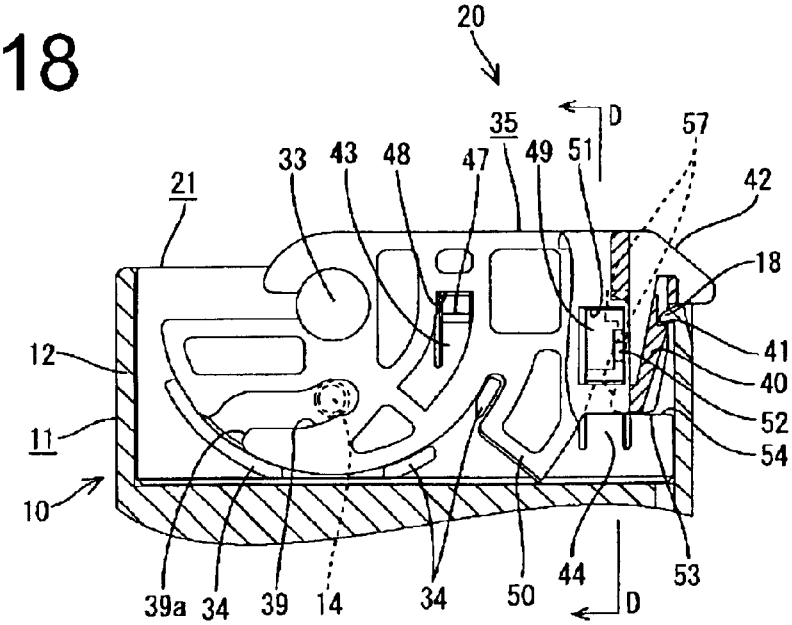
FIG. 18 is a plan view partly in section showing a state where the two connectors are completely connected.
Figure 19:
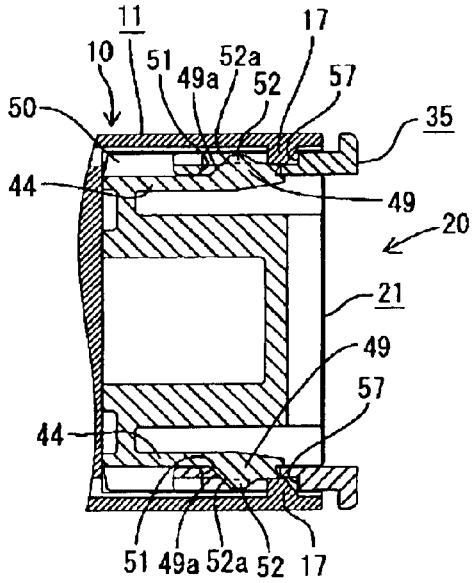
FIG. 19 is a section along 19—19 of FIG. 18.

The lever 35 at the initial position projects away from the mating side of the main body 21, as shown in FIG. 13, whereas the lever 35 at the end position is substantially along the housing main body 21, as shown in FIG. 18. As shown in FIGS. 13 and 18, the backward projection of the lever 35 from the main housing 21 is smaller at the end position than at the initial position. The end position is a shelter position (see FIG. 10) for the lever 35 during transportation, and a radial projection of the lever 35 from the outer surface of the housing 21 is smaller than at the initial position.

The female connector 20 has a holding means for holding the lever 35 at the initial position, the end position and/or the shelter position. The lever holding means comprise inwardly deformable first and second resilient pieces 43 and 44 at each of the opposite long walls 31 of the main housing 21, as shown in FIGS. 3 and 7. The first and second resilient pieces 43, 44 are backwardly extending cantilevers formed by cutting the longer walls 31. As shown in FIG. 3, a first excessive deformation preventing portion 45 is provided at a cut edge of each longer wall 31 at the back side of the first resilient piece 43 with respect to a deforming direction. The first excessive deformation preventing portion 45 prevents excessive deformation of the first resilient piece 43 by engaging the first resilient piece 43 before the first resilient piece 43 is deformed excessively. A second excessive deformation preventing portion 46 is provided at a cut edge of each longer wall 31 at the back side of the second resilient piece 44 with respect to a deforming direction and has a function similar to the first excessive deformation preventing portion 45.

Figure 4:
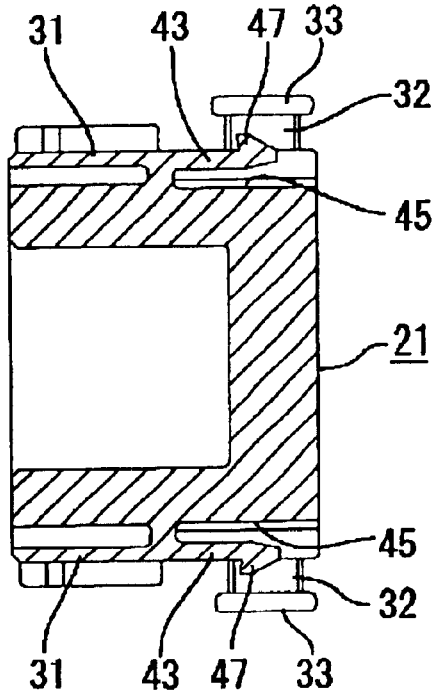
FIG. 4 is a section along 4—4 of FIG. 3.
Figure 8:
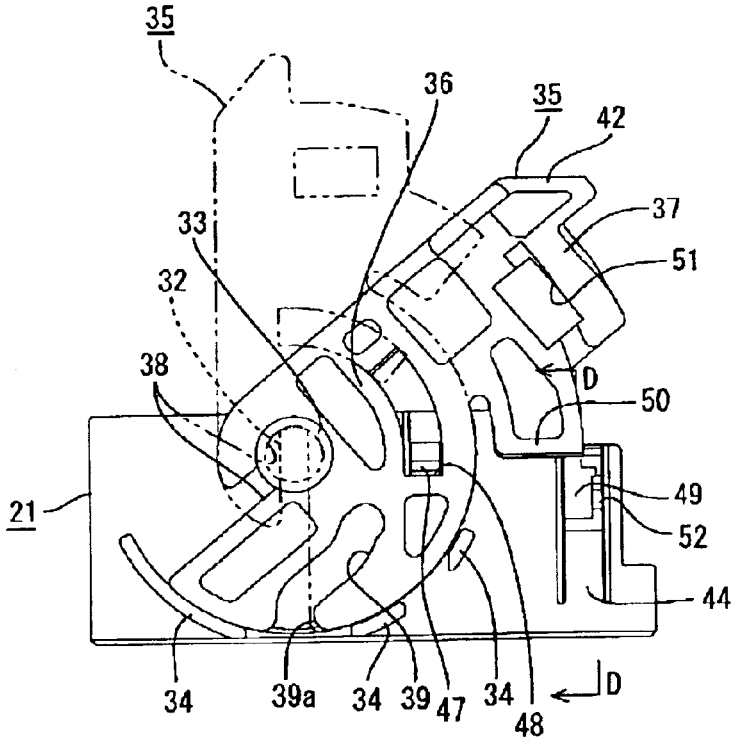
FIG. 8 is a plan view showing an operation of mounting the lever at an initial position on the main housing.

Each first resilient piece 43 is between the two right rotation guiding ribs 34, as shown in FIG. 7, and a first holding projection 47 projects outwardly from the free end of the first resilient piece 43. The first holding projections 47 enter first engaging holes 48 in the arms 36 near the back ends of the cam grooves 39 and have front surfaces engaged with the front edges of the first engaging holes 48, as shown in FIG. 8. Thus, the lever 35 cannot rotate counterclockwise from the initial position away from the end position. The front surfaces of the first holding projections 47 are at acute angles to the outer surfaces of the longer walls 31, as shown in FIG. 4, and are engaged firmly with the edges of the first engaging holes 48. Rear surfaces of the first holding projections 47 are at obtuse angles to the outer surfaces of the longer walls 31, so that resilient deformation of the first resilient pieces 43 is guided as the lever 35 is mounted.

Figure 5:
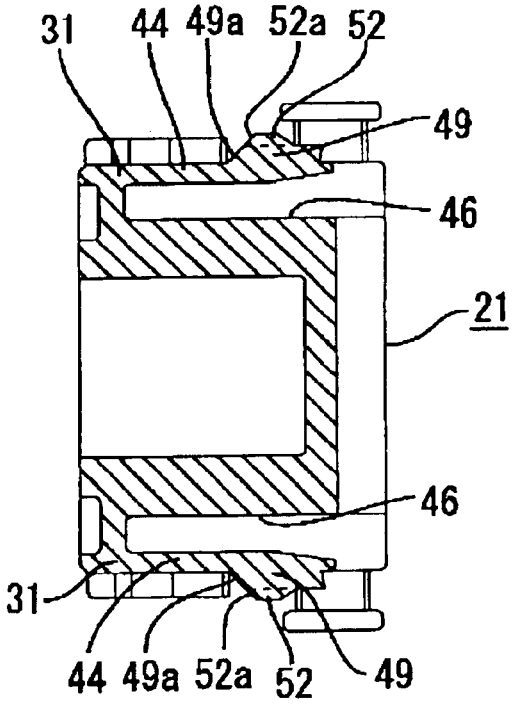
FIG. 5 is a section along 5—5 of FIG. 3.

The second resilient pieces 44 are longer and wider than the first resilient pieces 43 and are at the right ends of the longer walls 31, as shown in FIG. 7. Second holding projections 49 project from the outer surfaces of the free ends of the second resilient pieces 44. The front surfaces of engaging pieces 50 project at positions of the arms 36 near the coupling 37 and engage the rear surfaces of the second holding projections 49, as shown in FIG. 8, to prevent clockwise rotation of the lever 35 from the initial position. The rear surfaces of the second holding projections 49 are at acute angles to the outer surfaces of the longer walls 31, as shown in FIG. 5, to engage the engaging pieces 50 firmly.

Figure 14:
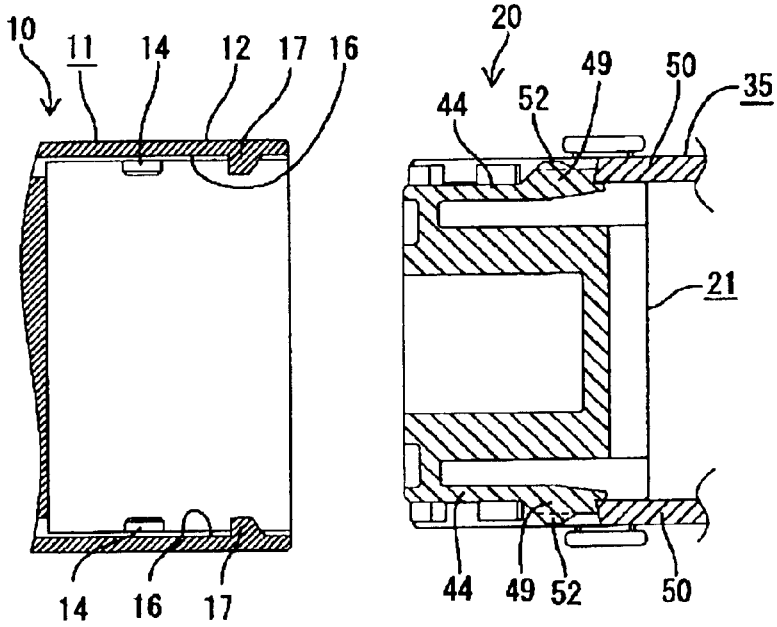
FIG. 14 is a section along 14—14 of FIG. 13.

The front surfaces of the engaging pieces 50 are slanted (see FIG. 14). On the other hand, the front of each second holding projection 49 defines a disengagement guiding surface 49*a* at an obtuse angle to the outer surface of the longer walls 31. Thus, the second resilient pieces 44 deform and disengage from the engaging pieces 50 as the disengagement projections 17 of the male connector 10 engage the front surfaces of the second holding projections 49 during the connection of the connectors 10, 20, (see FIG. 16).

Figure 10:
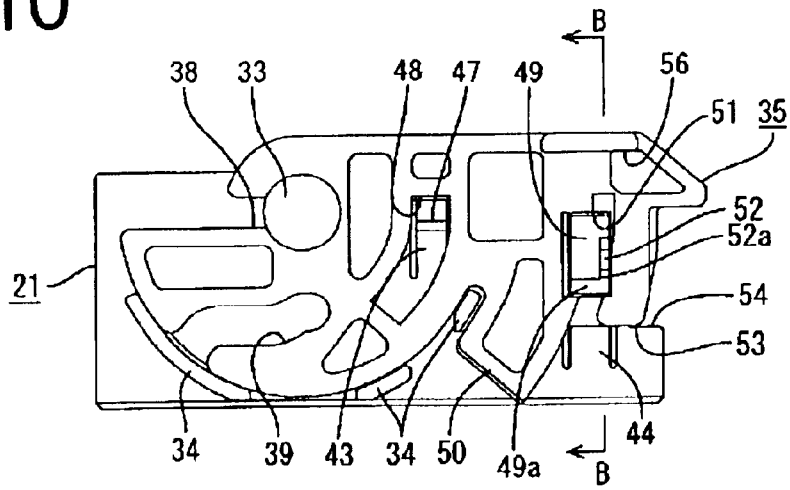
FIG. 10 is a plan view showing a state where the lever is mounted at a shelter position on the main housing.
Figure 11:
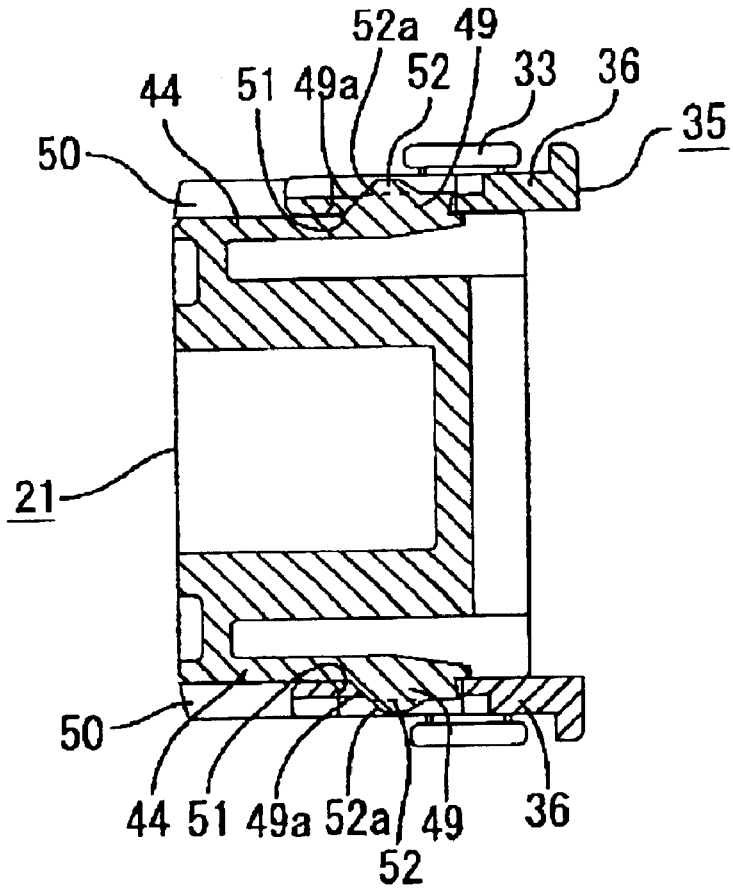
FIG. 11 is a section along 11—11 of FIG. 10.

When the lever 35 is at the shelter or end position, the second holding projections 49 enter substantially rectangular second engaging holes 51 on the arms 36 between the engaging pieces 50 and the coupling portion 37. As a result, the front and rear surfaces of the second holding projections 49 engage the front and rear edges of the second engaging holes 51, as shown in FIGS. 10 and 11, to hold the lever 35 at the shelter or end position in cooperation with the lock arm 40 (see FIGS. 18 and 19). A long narrow holding force reinforcing projection 52 extends along forward and backward directions and projects out at the right end of the outer surface of each second holding projection 49 to reinforce the holding force of the lever 35. Thus, the holding force for the lever 35 at the end position can be reinforced without degrading the rotational operability of the lever 35 when the connectors are to be separated. Slanted surfaces 52*a* are formed on the front surfaces of the reinforcing projections 52 and have an inclination substantially continuous with the disengagement guiding surfaces 49*a* formed on the front surfaces of the second holding projections 49. Thus, if the lever 35 is rotated toward the initial position from the shelter or end position by a force of a specified magnitude or larger, the second resilient pieces 44 automatically deform resiliently and disengage from the edges of the second engaging holes 51. Accordingly, the holding of the lever 35 at the shelter or end position by the second resilient pieces 44 is semi-locking. The rear surfaces of the holding force reinforcing projections 52 are at obtuse angles to the outer surfaces of the housing main body 21 to facilitate rotation of the lever 35 from the initial position to the shelter or end position, and the rear ends thereof are continuous with the outer surfaces of the second holding projections 49.

Figure 6:
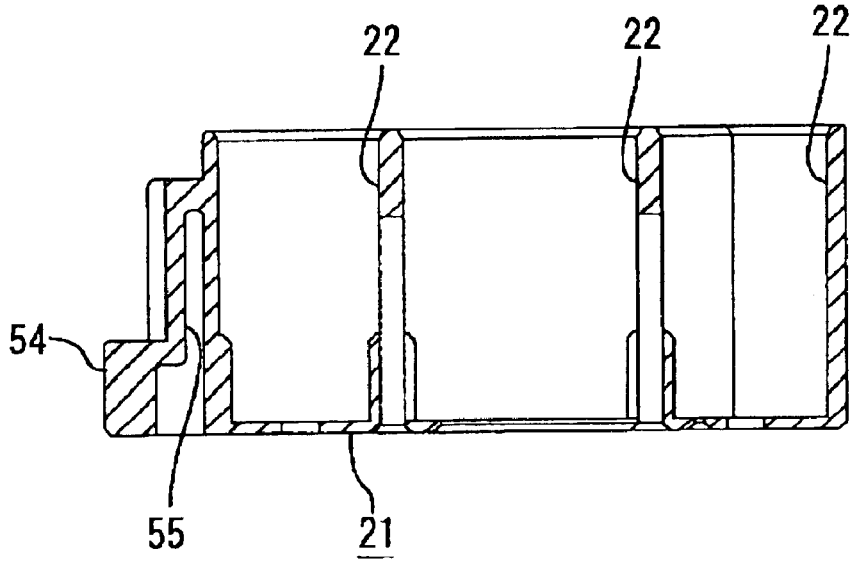
FIG. 6 is a section along 6—6 of FIG. 3.

A striker 53 is formed over the entire width of the end of the coupling 37 opposite from the operable portions 42 and a meeting portion 54 projects from the right end of the housing 21. The striker 53 strikes the meeting portion 54 as the lever 35 reaches the shelter or end position. A detection sound is created and the clockwise rotation of the lever 35 passed the shelter position and the end position is prevented when the striker 53 strikes against the meeting portion 54. When the lever 35 reaches the end position during connection of the two connectors 10, 20, both operable portions 42 of the lever 35 strike against the front end surface of the receptacle 12 of the male connector 10. An echoing space 55 opens forward at the left side of the meeting portion 54 of the main housing 21, as shown in FIGS. 2 and 6, for amplifying the detection sound. Further, the operable portions 42 provided behind the striking portion 53 of the lever 35 are formed with laterally open echoing spaces 56 which have the same function as the echoing space 55.

The escaping recesses 16 are formed in the inner surfaces of the receptacle 12 of the male connector 10, as described above, and permit the lever 35 to be opened outwardly during the rotation. As shown in FIG. 13, each escaping recess 16 has a length that extends over the entire length of the receptacle 12 along forward and backward directions and a width that extends between the right end position of the corresponding second resilient piece 44 of the female connector 20 and a position spaced slightly left of the left end of the corresponding engaging piece 50 of the lever 35 located at the initial position.

Figure 16A:
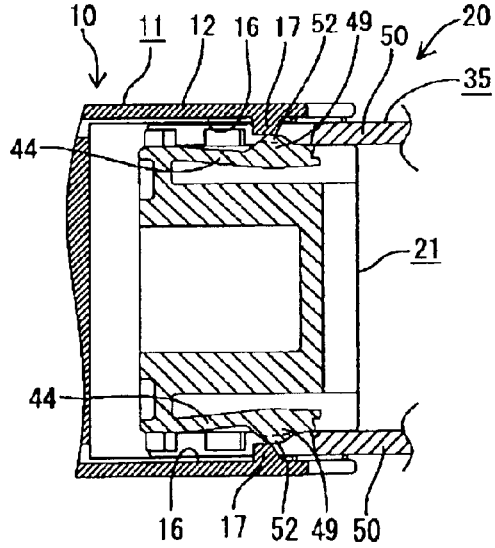
FIG. 16(A) is a section along 16A—16A of FIG. 15.
Figure 16B:
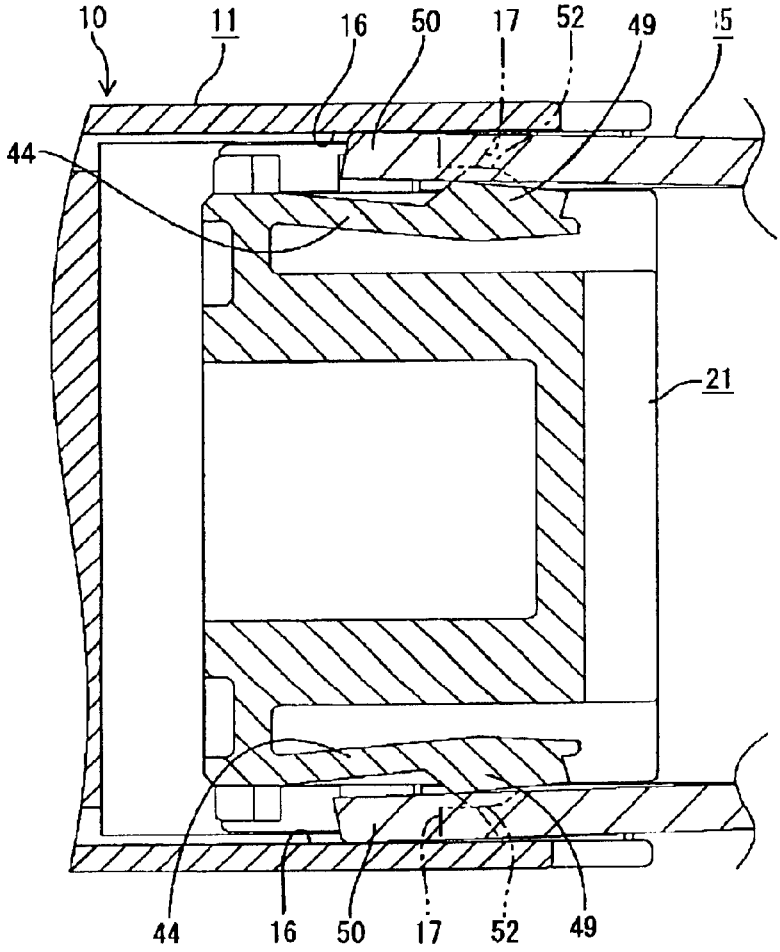
FIG. 16(B) is a section along 16B—16B of FIG. 15 showing a state where engaging pieces are opened outwardly due to restoring forces of second resilient pieces at an initial stage of rotation of the lever.

The engaging pieces 50 move beyond the second resilient pieces 44 during rotation of the lever 35 from the initial position toward the end position, and are subjected to the restoring forces of the second resilient pieces 44 that have been pressed inwardly by the disengagement projections 17. As a result, the engaging pieces 50 displace slightly outwardly as shown in FIG. 16(B). The depth of the escaping recesses 16 is sufficient to let the opened engaging pieces 50 escape.

Figure 9:
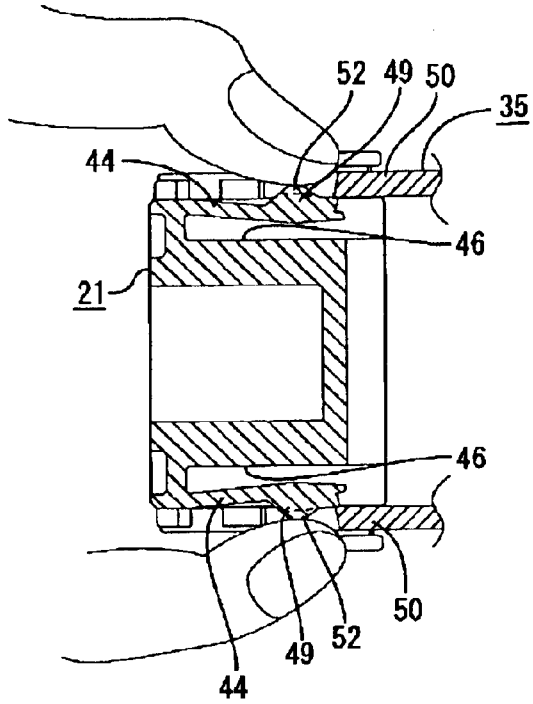
FIG. 9 is a section along 9—9 of FIG. 8 showing an operation of pressing two second resilient pieces.

The male housings 11 and the junction boxes are molded at a molding site and the male tab terminals are inserted to produce the lever-type connector. The main housings 21 of the female connectors 20, the divided housings 27 and the levers 35 also are molded at a molding site. The lever 35 is fitted on the main housing 21 from behind and is rotated temporarily to the initial position, as shown in FIGS. 7 and 8. The second resilient pieces 44 then are pressed by fingers from outer sides, as shown in FIG. 9, and deform inwardly to disengage from the engaging pieces 50. The lever 35 then is rotated to the shelter position, as shown in FIG. 10. As a result, the striking portion 53 of the lever 35 strikes against the meeting portion 54 of the main housing 21 and creates a detection sound to indicate that the lever 35 has reached the shelter position. Thereafter, the parts are packed in boxes and transported to an assembling site with the levers 35 at the shelter position on the main housings 21. The ability to disengage the second resilient pieces 44 by pressing in with fingers helps to achieve good operability.

The projecting amount of the lever 35 from the main housing 21 is smaller at the shelter position than at the initial position. Thus, interference of the lever 35 with other parts during transportation can be avoided, and the lever 35 is not likely to be damaged. In addition, more parts can be packed efficiently in a limited space, thereby contributing to lower transportation costs. The lever 35 is held at the shelter position by the second holding projections 49 and the holding force reinforcing projections 52 of the resiliently restored second resilient pieces 44 engage the edges of the second engaging holes 51, as shown in FIG. 11. Thus, a sufficient holding force is ensured, and the lever 35 will not move from the shelter position during transportation.

The main housings 21 may strike each other during transportation due to vibration and one main housing 21 may interfere with the first and second resilient pieces 43, 44 of another main housing 21. However, the first excessive deformation preventing portions 45 are behind the first resilient pieces 43 with respect to their deforming direction and the second excessive deformation preventing portions 46 are behind the second resilient pieces 44 with respect to their deforming direction. Thus, the excessive deformation preventing portions 45, 46 engage the respective resilient pieces 43, 44 and prevent the resilient pieces 43, 44 from experiencing a plastic deformation. Therefore, the resilient pieces 43, 44 will not be damaged.

The female terminal fittings connected with the wires are inserted in the cavities 23 of the main housing 21 and in the cavities 28 of the divided housings 27 at the assembly site. The divided housings 27 then are inserted into the respective accommodation chambers 22 of the main housing 21 with the lever 35 at the shelter position, as shown in FIG. 12. The divided housings 27 can be inserted smoothly because the coupling 37 of the lever 35 at the shelter position is retracted sideways from the accommodation chambers 22. Thereafter, the lever 35 is rotated counterclockwise from the shelter position, and the second resilient pieces 44 are guided by the disengagement guiding surfaces 49*a* of the second holding projections 49 and the slanted surfaces 52*a* of the holding force reinforcing projections 52. Thus, the second resilient pieces 44 deform resiliently and disengage from the edges of the second engaging holes 52, and the lever 35 is returned to the initial position, as shown in FIG. 13. The semi locking of the lever 35 by the second resilient pieces 44 achieves good operability. The engaging pieces 50 engage the second holding projections 49 of the second resilient pieces 44 to hold the lever 35 at the initial position with a sufficient holding force, as shown in FIGS. 13 and 14. Thus, displacement of the lever 35 from the initial position can be prevented before the connectors 10, 20 are connected.

Figure 15:
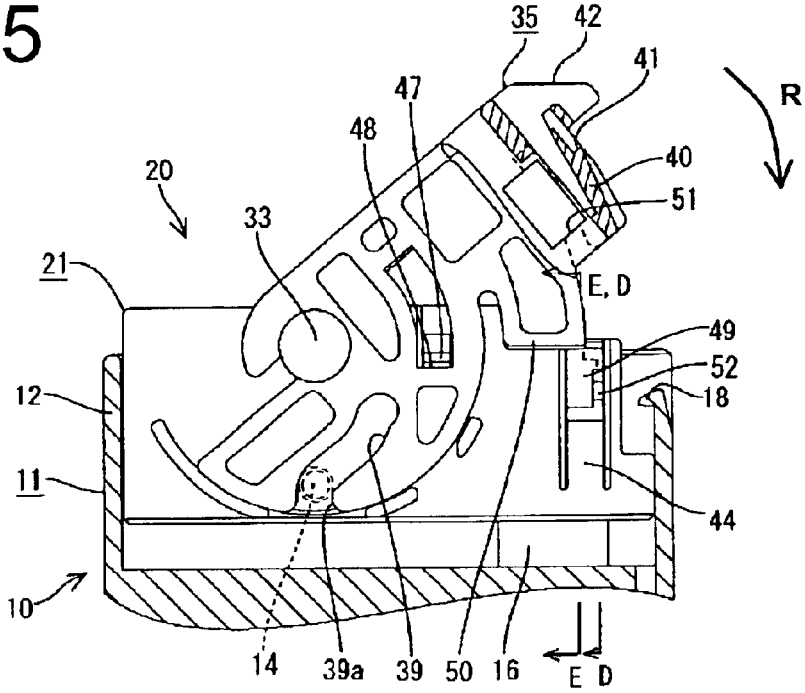
FIG. 15 is a plan view partly in section showing a state at an initial stage of connection of the two connectors.
Figure 17:
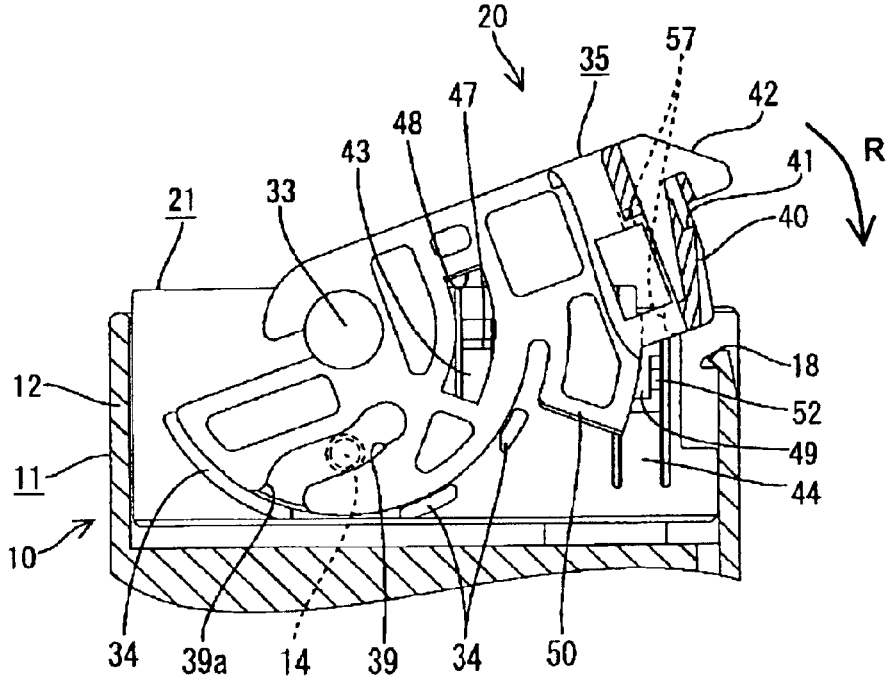
FIG. 17 is a plan view partly in section showing a state at an intermediate stage of the connection of the two connectors.

The assembled female connector 20 is fit lightly into the receptacle 12 of the male connector 10 from above and the cam pins 14 enter the entrances 39*a* of the cam grooves 39, as shown in FIG. 15. During this process, the disengagement projections 17 engage the second holding projections 49. Thus, the second resilient pieces 44 deform inwardly and are guided by the disengagement guiding surfaces 49*a* out of engagement with the engaging pieces 50, as shown in FIG. 16. In this way, the lever 35 can rotate clockwise in direction R from the initial position. As the lever 35 is rotated, the cam pins 14 move along the cam grooves 39, as shown in FIG. 17, and the connection of the two connectors 10, 20 progresses. The connectors 10, 20 are connected completely when the lever 35 reaches the end position, and the lock projection 18 engages the locking step 41 of the lock arm 40, as shown in FIG. 18. At this time, the second holding projections 49 enter the second engaging holes 51 and engage the front and rear edges of the second engaging holes 51. The lock arm 40 and the second resilient pieces 44 lock the connectors 10, 20 together. The striking portion 53 of the lever 35 strikes the meeting portion 54 of the main housing 21 to create a detection sound as the connectors 10, 20 are connected completely. Thus, the lever 35 will not be left with the connectors 10, 20 only partly connected. The escaping grooves 57 at the front and rear edges of the second engaging holes 51 of the arms 36 accommodate the disengagement projections 17 of the male connector 10 during the process of the connection and at the time of the complete connection.

The engaging pieces 50 may open outwardly as the lever 35 is rotated due to the restoring forces of the second resilient pieces 44 that have been deformed resiliently by the disengagement projections 17, as shown in FIG. 16(B). However, the escaping recesses 16 on the inner surfaces of the receptacle 12 face the engaging pieces 50. Thus, the engaging pieces 50 can displace outwardly into the escaping recesses 16, and the lever 35 can rotate smoothly without the opened engaging pieces 50 catching the inner surfaces of the receptacle 12.

The connectors 10, 20 can be separated for a maintenance or other reason by first deforming the lock arm 40 away from the lock projection 18 and then rotating the lever 35 counterclockwise from the end position to the initial position. The second resilient pieces 44 are guided by the disengagement guiding surfaces 49*a* of the second holding projections 49, and are deformed automatically away from the edges of the second engaging holes 51. The cam pins 14 move along the cam grooves 39 and toward the entrances 39*a* as the rotation progresses. Thus, the connectors 10, 20 gradually separate and can be pulled apart when the lever 35 reaches the initial position.

As described above, the second resilient pieces 44 are used as the holding means for holding the lever 35 at two positions, i.e. the initial position, and the end or shelter position. Thus, the connector has a simple construction as compared to a case where the second resilient pieces 44 do not perform two functions. Further, as the lever 35 is rotated to connect the connectors 10, 20, the disengagement projections 17 deform the second resilient pieces 44 to cancel the holding by the second resilient pieces 44, thereby taking advantage of the connecting operation. Thus, the rotational operability of the lever 35 is better than if engaged projections and recesses hold the lever 35.

The second resilient pieces 44 are at opposite sides of the main housing 21, and easily can be deformed inwardly by fingers. Thus, the lever 35 can be rotated easily to the shelter position for transportation. Further, the engaging pieces 50 for engaging the second resilient pieces 44 are near the outer end of the trace of rotation of the lever 35. Thus, a sufficient holding force can be ensured for holding the lever 35 at the initial position.

The disengagement guiding surfaces 49*a* on the second resilient pieces 44 achieve semi-locking of the lever 35 at the shelter position. Thus, the lever 35 can be returned easily to the initial position at the assembly site. Furthermore, the second resilient pieces 44 have the holding force reinforcing projections 52 and the slanted surfaces 52*a* having an inclination continuous with the disengagement guiding surfaces 49*a* are formed on the holding force reinforcing projections 52. Thus, the holding force for the lever 35 can be reinforced without degrading the rotational operability.

The connector is simplified further because the end position and the shelter position of the lever 35 are identical and the lever 35 is held at the two different positions by the second resilient pieces 44. Further, movement of the lever 35 to the end position and the shelter position can be detected by the detection sound, and the lever 35 will not be left at an intermediate position.

As described above, the first and second resilient pieces 43 and 44 are provided by cutting the longer walls 31 of the main housing 21. The cut edges of the longer walls 31 define the first and second excessive deformation preventing portions 45, 46 at the back sides of the respective resilient pieces 43, 44. The excessive deformation preventing portions 45, 46 prevent excessive deformation of the resilient pieces 43, 44. Therefore, the resilient pieces 43, 44 are not likely to be damaged during transportation.

The engaging pieces 50 may open outwardly due to the restoring forces of the second resilient pieces 44 at the initial stage of the rotation of the lever 35. However, the escaping recesses 16 permit the engaging pieces to escape. Therefore, the rotational operability of the lever 35 is satisfactory.

The present invention is not limited to the above described and illustrated embodiment. For example, the following embodiments are also embraced by the invention as defined by the claims. Beside the following embodiments, various changes can be made without departing from the scope and spirit of the present invention as defined by the claims.

Although the end position and shelter position of the lever are identical in the foregoing embodiment, they may be separate if there is a restriction due to the construction of the connector and how the connector is used.

Although the resilient pieces are used as the holding means for the lever in the foregoing embodiment, the lever may be held, for example, by engaging a projection on the main housing with a recess formed in the lever.

Although the male connector is integral or unitary with the junction box in the foregoing embodiment, a male connector for accommodating male terminal fittings connected with ends of wires may be connected with the female connector of the foregoing embodiment.

Although the lever is mounted on the female connector in the foregoing embodiment, the lever may be mounted on the male connector.

Although the main housings and the levers are transported separately in the foregoing embodiment, they may be packed and transported with the levers on the main housings. In such a case, if the levers are mounted at the end position on the main housings, the levers can cover the second resilient pieces and a projecting amount of the levers from the main housings is small as compared to a case where the levers are at the initial position.

Although the cut edges of the housing main body are the excessive deformation preventing means in the foregoing embodiment, excessive deformation preventing members separate from the housing main housing may be mounted on the main housing.

Although the invention has been described with reference to a lever rotatably mounted on the main housing it should be understood that the invention is also applicable to other types of movable members, e.g. a movable member being substantially linearly movable between the initial position and the end position. The movable member may move on any other kind of path or trace such as a non-linear path, an elliptical path, a parabolic path, etc.

Although the invention has been described with respect to a cam groove on the lever and a cam pin on the mating housing it should be understood that the invention is also applicable to a connector in which the lever has a cam pin and the mating housing has a cam groove.

What is claimed is:

1. A connector, comprising:

a housing connectable with a mating housing, a movable member formed with a cam groove and movably mountable on the housing for movement between a shelter position, an initial position and an end position, the movable member defining projecting distances from the housing in each of said positions, the projecting distance of the movable member from the housing in the shelter position being less than the projecting distance of the movable member from the housing in the initial position, the housing and the mating housing being connected with and separated from each other by displacing a cam pin on the mating housing along the cam groove as the movable member is moved between the initial position and the end position, a first position holding means on the housing for selectively and releasably holding the movable member at either of the shelter and initial positions, end position holding means on the mating housing for holding the movable member at the end position.

2. The connector of claim 1, wherein the movable member is a lever rotatably mountable on the first housing.

3. The connector of claim 1, wherein the first position holding means comprises at least one resiliently deformable resilient piece unitarily formed with the housing, the movable member being held at the initial position and the shelter position by engagement of the resilient piece with a an initial position engaging portion and a shelter position engaging portion, respectively, on the movable member.

4. The connector of claim 3, wherein at least one of the resilient piece and the shelter position engaging portion is formed with a disengagement guiding surface slanted to guide a resilient deformation of the resilient piece away from the third-shelter position engaging portion when a force of at least a specified magnitude acts on the movable member to move the movable member toward the initial position.

5. The connector of claim 3, wherein the at least one resilient piece comprises two resilient pieces on opposite side surfaces of the housing and being resiliently deformable inwardly toward one another.

6. The connector of claim 5, wherein the first initial position engaging portion is near an outer end of a trace of movement of the movable member.

7. The connector of claim 1, wherein the shelter position and a end position of the movable member are substantially identical.

8. The connector of claim 7, further comprising a detection sound creating means at a portion where the movable member having reached the shelter position and the end position is struck against the housing for amplifying a detection sound as the movable member is struck against the housing.

9. A connector, comprising:

a housing connectable with a mating housing, a movable member formed with a cam groove and movably mountable on the housing between first, second and third positions, the housing and the mating housing being connected with and separated from each other by displacing a cam pin on the mating housing along the cam groove as the movable member is moved between the first position and the second position, at least one resiliently deformable piece unitarily formed with the housing, the movable member being held at the first position and the third position by the engagement of the resilient piece with a first position engaging portion and a third position engaging portion, respectively, on the movable member, at least one of the resilient piece and the third position engaging portion being formed with a disengaging guiding surface slanted to guide a resilient deformation of the resilient piece away from the third position engaging portion when a force of at least a specified magnitude acts on the movable member to move the movable member toward the first position, and wherein the resilient piece comprises a holding force reinforcing projection projecting in a direction opposite from a deforming direction of the resilient piece and having a slanted surface continuous with the disengagement guiding surface.

10. A connector, comprising:

a housing connectable with a mating housing, a movable member formed with a cam groove and movably mountable on the housing, the two housings being connected with and separated from each other by displacing a cam pin on the mating housing along the cam groove as the movable member is moved between a first position and a second position, at least one resilient piece formed on the housing and being resiliently deformable away from the housing for holding the movable member at the first position by engaging the movable member, and at least one excessive deformation preventing means for preventing an excessive deformation of the resilient piece away from the movable member.

11. The connector of claim 10, wherein the resilient piece is formed by cutting an outer wall of the housing, and the excessive deformation preventing means is formed by a cut edge of the outer wall left at a back side with respect to a deforming direction of the resilient piece (43;44).

12. The connector of claim 10, wherein a first position engaging portion engageable with the resilient piece when the movable member is at the first position is near an outer end of a trace of movement of the movable member.

* * * * *